US009557754B2

(12) United States Patent
Panosyan et al.

(10) Patent No.: US 9,557,754 B2
(45) Date of Patent: Jan. 31, 2017

(54) LOAD TAP CHANGER

(71) Applicant: GENERAL ELECTRIC COMPANY, Schenectady, NY (US)

(72) Inventors: Ara Panosyan, Munich (DE); Eva-Maria Baerthlein, Hamburg (DE); Simon Herbert Schramm, Moosach (DE); Stefan Schroeder, Munich (DE); Rohit Kumar Gupta, Bangalore (IN); Pinwan Thiwanka Bandara Wijekoon, Munich (DE); Malcolm Graham Smith, Jr., Haughton, LA (US)

(73) Assignee: General Electric Company, Niskayuna, NY (US)

( * ) Notice: Subject to any disclaimer, the term of this patent is extended or adjusted under 35 U.S.C. 154(b) by 380 days.

(21) Appl. No.: 14/258,667

(22) Filed: Apr. 22, 2014

(65) Prior Publication Data

US 2015/0301538 A1 Oct. 22, 2015

(51) Int. Cl.

| | |
|---|---|
| ***H01F 29/04*** | (2006.01) |
| ***G05F 1/20*** | (2006.01) |
| ***H01H 9/00*** | (2006.01) |

(52) U.S. Cl.

CPC ..... *G05F 1/20* (2013.01); *H01F 29/04* (2013.01); *H01H 9/0005* (2013.01)

(58) Field of Classification Search

CPC ..... H02M 5/10; G05F 1/22; G05F 1/14
USPC ..... 323/255, 340, 343
See application file for complete search history.

(56) References Cited

U.S. PATENT DOCUMENTS

| | | | | |
|---|---|---|---|---|
| 5,006,784 | A | 4/1991 | Sonntagbauer | |
| 7,355,369 | B2 * | 4/2008 | Lavieville | H01F 29/04 323/255 |
| 7,595,614 | B2 | 9/2009 | Stich et al. | |
| 8,289,068 | B2 | 10/2012 | Brueckl et al. | |
| 2008/0074073 | A1 * | 3/2008 | Genkawa | H02P 13/06 318/779 |
| 2012/0306471 | A1 * | 12/2012 | Green | H01H 9/542 323/355 |
| 2012/0313594 | A1 | 12/2012 | Brueckl et al. | |

(Continued)

FOREIGN PATENT DOCUMENTS

WO 0122447 A1 3/2001

OTHER PUBLICATIONS

G.H. Cooke et al., "New thyristor assisted diverter switch for on load transformer tap changers", IEE Proceedings—B, vol. 139, No. 6, pp. 507-511, Nov. 1992.

(Continued)

*Primary Examiner* — Adolf Berhane
*Assistant Examiner* — Afework Demisse
(74) *Attorney, Agent, or Firm* — Nitin N. Joshi

(57) ABSTRACT

A method of switching taps of an on-load tap changer includes providing a main finger, a first side finger including a first solid state switch and a second side finger including a second solid state switch. The main finger, the first side finger and the second side finger are utilized to provide a connection between the taps and a power terminal of the on-load tap changer. The method also includes triggering the on-load tap changer to shift the fingers from a first tap to a second tap of the on-load tap changer when a tap change signal is received and utilizing the first solid state switch and the second solid state switch to commutate a current during the tap change operation.

20 Claims, 3 Drawing Sheets

(56) References Cited

U.S. PATENT DOCUMENTS

2014/0055225 A1 2/2014 Rosado et al.

OTHER PUBLICATIONS

D. J. Rogers et al., "A Hybrid Diverter Design for Distribution Level On-load Tap Changers", IEEE, Energy Conversion Congress and Exposition (ECCE), , Sep. 12-16, 2010, pp. 1493-1500.
D. Gao et al., "A New Scheme for On-Load Tap-Changer of Transformers," IEEE, Power System Technology, vol. 2, pp. 1016-1020, 2002.
D, Dohnal, "On-Load Tap-Changers for Power Transformers A Technical Digest," MR Publication, Jun. 26, pp. 1-28, 2006.

* cited by examiner

LOAD TAP CHANGER

BACKGROUND

Embodiments of the system relate generally to a field of voltage regulation and more specifically to an on-load tap changer for power delivery.

Conventionally, electricity is generated in large-scale power plants that are connected to a transmission grid through step up transformers. Electrical power is transmitted over a transmission system over long distances at very high voltages. At distribution substations the voltage is stepped down and power is supplied to different loads within a distribution grid. Voltage regulation in the distribution grid is typically achieved either through On-Load Tap Changing (OLTC) transformers or voltage regulators. Capacitor banks are also widely used in many utilities to support the voltage in distribution grids, where voltage variations are mainly caused by slow variation of loads connected to the distribution system. The increasing share of intermittent and highly variable renewable energy generation connected at distribution level leads to larger and more frequent voltage fluctuations in distribution grids, which requires more flexibility in network voltage regulation. As a consequence, on-load tap changers in distribution grids with large amount of renewable energy generation are being utilized more intensively and extensively.

On-load tap changers have been widely used for power transformers and voltage regulators for many years. Several types of on-load tap changers, both mechanical and electronic, are available in the market. Mechanical on-load tap changers allow for in-service operation, but have demanding mechanical requirements. Each tap changing operation of mechanical tap changers leads to a certain amount of arcing between tap contacts and moving finger contacts. Arcing leads to slow deterioration of the transformer oil and the wear of the mechanical contacts. The lifetime of a mechanical tap changer is hence limited by the number of tap changing operations. Conventional on-load tap changers have nevertheless relatively long lifetime of 15-20 years. This is mainly due to the relatively low number of tap changing operations required to regulate the voltage variations due to load variations. However, due to larger and faster voltage fluctuations in distribution networks caused by the increasing share of distributed renewable energy sources, on-load tap changers are required to switch much more often than before. This leads to much higher maintenance requirements and limited lifetime.

The main drawback of mechanical on-load tap changers is unavoidable arcing between the tap contacts and the moving finger contacts when a tap is changed. Purely electronic on-load tap changers on the other hand do not have any moving finger contacts. Each tap contact is connected to the load through a solid-state electronic switch. The tap position is selected by switching on the corresponding electronic switch (i.e. conducting), while all other switches are switched off (i.e. not conducting). Changing from one tap position to the other is carried out by commutating the current from one electronic switch to the next. The current commutation and tap change is therefore achieved without arcing due to the typically very fast switching capabilities of solid-state switches. Although electronic on-load tap changers are highly flexible and can operate arc-free and would therefore substantially reduce maintenance requirements as compared to mechanical on-load tap changers, they also have certain disadvantages. The main disadvantage is the cost of electronic switches, also because an electronic switch is required for each tap position, which further increases the cost when large number of taps is needed. The second disadvantage is the higher losses of electronic switches compared to mechanical contacts.

Therefore, there still exists a need for an economically more viable as well as technically reliable and efficient alternative solutions for on-load tap changers.

BRIEF DESCRIPTION

In accordance with an embodiment of the present technique, a method of switching taps of an on-load tap changer is provided. The method includes providing a main finger, a first side finger including a first solid state switch and a second side finger including a second solid state switch, wherein the main finger, the first side finger and the second side finger are utilized to provide a connection between the taps and a power terminal of the on-load tap changer. The method further includes triggering the on-load tap changer to shift the fingers from a first tap to a second tap of the on-load tap changer when a tap change signal is received and utilizing the first solid state switch and the second solid state switch to commutate a current during the tap change operation.

In accordance with another embodiment of the present technique, an on-load tap changer is provided. The on-load tap changer includes a main finger, a first side finger including a first solid state switch, and a second side finger including a second solid state switch, wherein the main finger, the first side finger and the second side finger are utilized to provide a connection between the taps and a power terminal of the on-load tap changer. The on-load tap changer also includes a controller configured to provide switching signals to the first solid state switch and the second solid state switch to commutate a current between the first solid state switch and the second solid switch during the tap change operation.

In accordance with yet another embodiment of the present technique, a method of operating an on-load tap changer is provided. The method includes providing a main finger, a first side finger including a first solid state switch and a second side finger including a second solid state switch, wherein the main finger, the first side finger and the second side finger are utilized to provide a connection between the taps and a power terminal of the on-load tap changer. The method also includes triggering the on-load tap changer to shift the fingers from a first tap to a second tap of the on-load tap changer when a tap change signal is received, wherein the first side finger breaks a contact with the first tap and then makes a contact with the second tap after the main finger and the second side finger breaks a contact with the first tap and then make a contact with the second tap before the main finger. The method further includes transferring an electric current flowing in the main finger to the first solid state switch, diverting the electric current flowing in the first solid state switch to the second solid state switch and transferring the electric current flowing in the second solid state switch back to the main finger during the tap change operation.

DRAWINGS

These and other features, aspects, and advantages of the present invention will become better understood when the following detailed description is read with reference to the accompanying drawings in which like characters represent like parts throughout the drawings, wherein.

Figure 2:
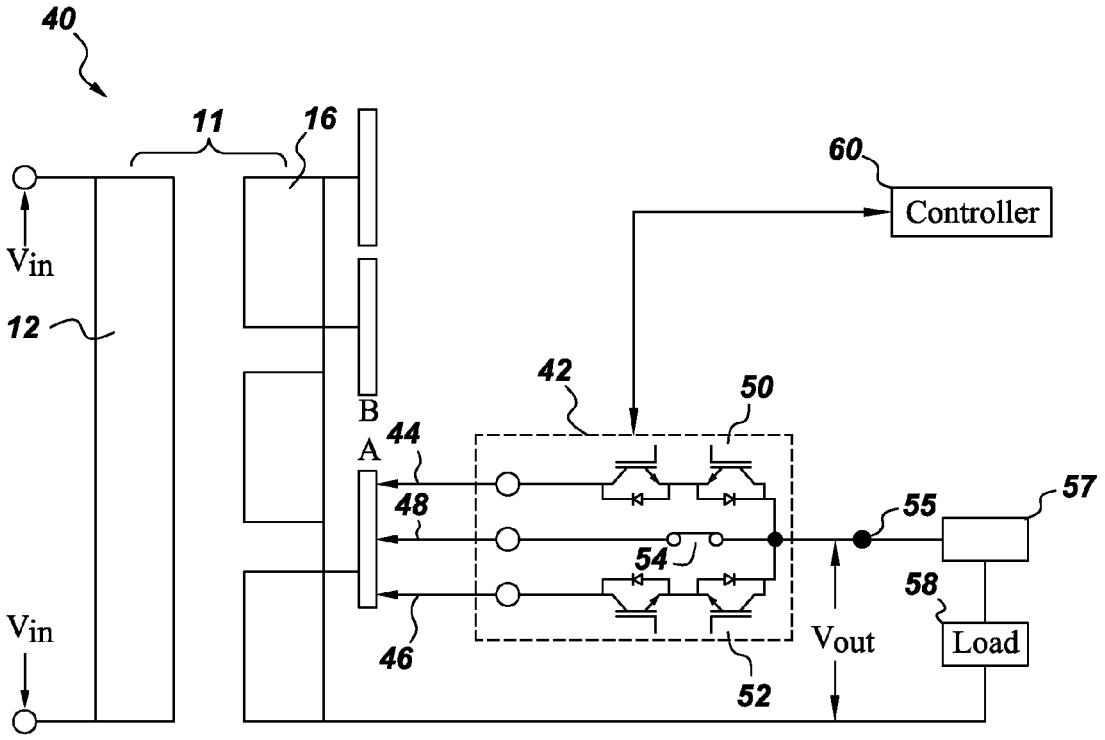
FIG. 2 is a schematic diagram of a transformer with a hybrid on-load tap changer in accordance with an embodiment of the present system.
Figures 3A, 3B, 3C, 3D, 3E, 3F, 3G, 3H, 3I, 3J:
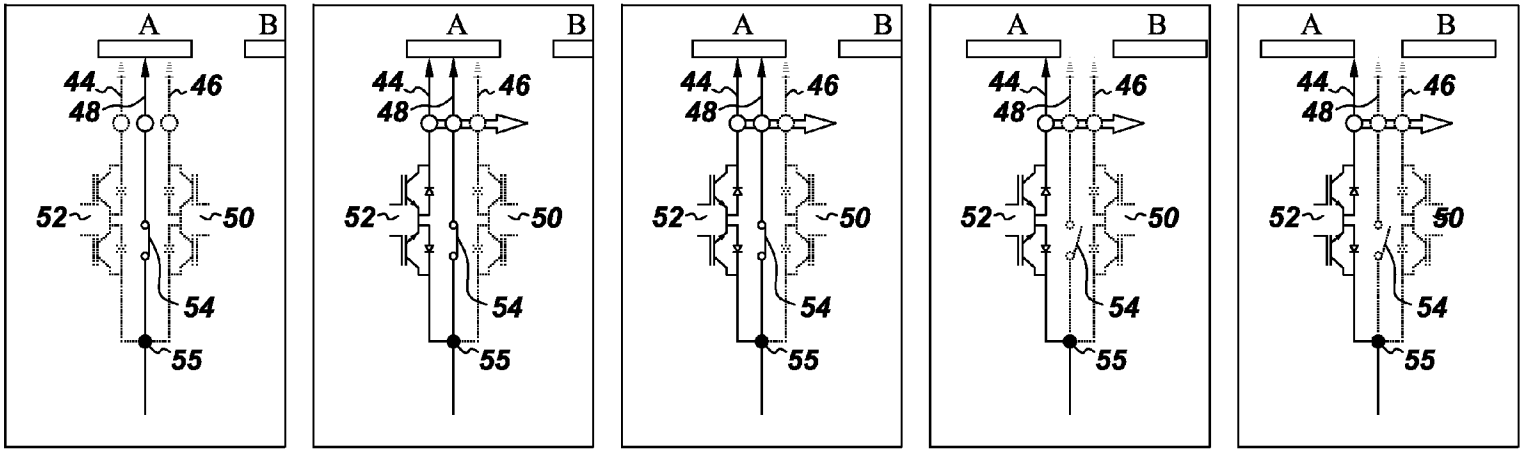
Figure 4:
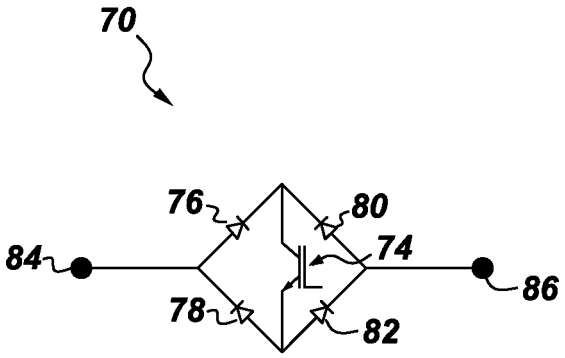

FIGS. 3*a* to 3*j* are schematic diagrams of various steps in an operation of the electronic on-load tap changer of FIG. 2 in accordance with an embodiment of the present technique; and FIG. 4 is a schematic diagram of a solid state switch in accordance with an embodiment of the present technique.

DETAILED DESCRIPTION

As used herein, the terms "controller" or "module" refers to software, hardware, or firmware, or any combination of these, or any system, process, or functionality that performs or facilitates the processes described herein.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The invention includes embodiments that relate to an on-load tap changer utilized for voltage regulation by changing connections from one tap to another of a voltage conversion device. Though the present discussion provides examples in the context of the on-load tap changer for a transformer, these load tap changers can be applied to any other device utilizing taps.

Figure 1:
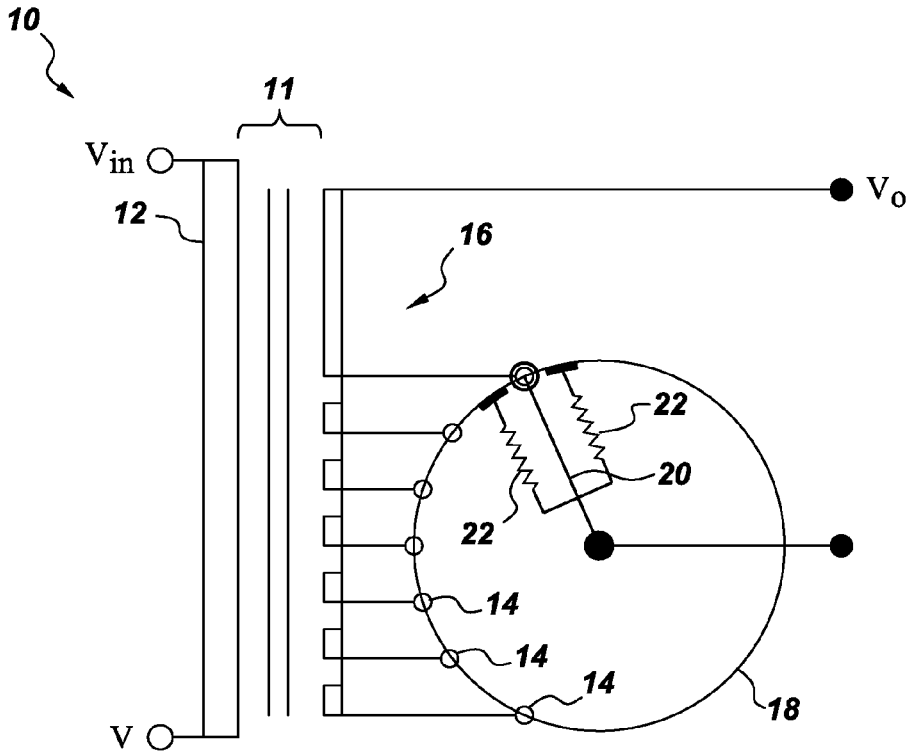
FIG. 1 is a schematic diagram of a transformer with a mechanical on-load tap changer.

FIG. 1 shows a schematic diagram 10 of a transformer 11 with a selector switch type mechanical on-load tap changer 18. Transformer 11 is one type of a voltage conversion device which converts a voltage from one level to another level and includes a primary winding 12 and a secondary winding 16 with a plurality of taps 14. In one embodiment, taps 14 may be provided on primary winding 12 or secondary winding 16 or both on primary winding 12 as well as secondary winding 16. In one embodiment, secondary winding 16 provides an output voltage Vo at a reduced level compared to an input voltage Vin of transformer 11. It should be noted that the magnitude and frequency of voltage variations at each point in the distribution grid may vary significantly depending on a number of factors, like the variation of loads and generation, electrical distance from the substation, type of electrical lines and voltage conditions on the high voltage side of the substation. On-load tap changing transformers and voltage regulators are therefore used to compensate for these voltage variations by changing their output voltage Vo.

When the voltage is above or below certain voltage set points a controller (not shown) activates a tap change operation to move finger contacts of on-load tap changer 18 to the next lower or higher tap. In general, transformer output voltage Vo is given as:

$$Vo=Vin*(T2/T1) \quad (1)$$

where T2 are secondary winding turns and T1 are primary winding turns. The tap position 14 on secondary winding 16 decides the number of turns T2. Thus, if output voltage Vo needs to be increased, taps 14 are changed such that winding turns T2 will increase. Similarly, when output voltage Vo needs to be decreased, taps 14 are changed appropriately to decrease turns T2.

Mechanical on-load tap changer 18 which includes a rotary mechanical switch 21 with a main finger 20 and two resistive side fingers 22, 23 is utilized to switch from one tap 14 position to another tap 14 position. For switching from one tap position to another, mechanical on-load tap changer 18 utilizes a drive system (not shown) and rotates main finger 20 and two resistive side fingers 22, 23 in anticlockwise or clockwise direction depending on the voltage change requirement. At steady state operating position, main finger 20 of rotary mechanical switch 21 is in contact with a first active tap. The two resistive side fingers 22, 23 may be in the air and not connected to any tap. The entire load current flows through main finger 20, while the two resistive side fingers carry zero current. During the movement, at start first resistive side finger 22 makes contact with the first tap with which the main finger 20 is also in contact with. The current flow through this first side resistive finger 22 is still very small, due to the large value of the transition resistor of the side finger compared to the resistivity of the main finger, which continues carries most of the current. Then main finger 20 breaks contact with the first tap and the entire load current is commutated to the first resistive side finger 22, which is still connected to the first tap. Subsequently, the second resistive side finger 23 makes contact with the second adjacent tap. This results in short circuit between two taps 14 through two resistive side fingers 22 and 23. The voltage difference between the two adjacent taps drives the circulating short circuit current, which is limited by the transition resistors on the two resistive side fingers. The first resistive side finger 22 then breaks contact with the first tap and the load current is commutated to the second resistive side finger 23 connected to the second tap. Finally, main finger 20 contacts the second tap and takes most of the current. Then the second resistive side finger 23 brakes contact with the second tap transferring the entire load current to the main finger 20 and therewith completing the tap change operation. The function of transition resistors of first and second resistive side finger 22 and 23 is to limit the circulating currents during the period when two adjacent taps are short circuited, which usually lasts 20-30 ms. Transition resistors are therefore designed for short-term loading.

FIG. 2 shows a schematic diagram 40 of transformer 11 with a hybrid on-load tap changer 42 in accordance with an embodiment of the present invention. The hybrid on-load tap changer may also be referred to as electronically assisted or solid state assisted on-load tap changer. Hybrid on-load tap changer 42 includes three fingers, a first side finger 46, a second side finger 44 and a third or main finger 48 respectively. Second side finger 44 includes a second solid state switch 50, first side finger 46 includes a first solid state switch 52 and main finger 48 is merely a mechanical contact. All three fingers 44, 46, 48 are connected to a power terminal 55 on one end to carry an electric current and provide a connection between transformer taps and power terminal 55. The term "power terminal" refers to an output terminal or an input terminal of the tap changer depending on the current flow. In one embodiment, on-load tap changer 42 is triggered to shift the fingers from one tap to another tap of the on-load tap changer when a tap change signal is received. The tap change operation may be for changing from a higher tap to a lower tap or vice versa. In other words, tap change operation includes clockwise or anticlockwise tap change operation. In one embodiment, the fingers 44, 46, 48 may be part of a rotary or linear switching mechanism to move the three fingers from one tap position to the next. Furthermore, solid state switches 50 and 52 are utilized to commutate a load current during the tap change operation.

A load 58 shown for representative purposes is connected to power terminal 55 via a wire or a cable 57.

Each of solid state switches 50 and 52 may be an unidirectional switch or a bidirectional solid state switch i.e., a switch which allows passage of current in either direction. In one embodiment, a bidirectional switch may comprise two unidirectional switches. Examples of the unidirectional solid state switch include a thyristor and a gate turn off thyristor (GTOs), whereas examples of the bidirectional solid state switch include a thyristor pair connected in antiparallel configuration and a triode for alternating current (TRIAC). In one embodiment, when solid state switch 50 or 52 is an unidirectional solid state switch, it can be turned ON during a forward bias condition. As will be appreciated by those skilled in the art the forward bias condition occurs when an anode of the unidirectional solid state switch is connected to a positive voltage and a cathode of the unidirectional solid state switch is connected to a negative voltage. When solid state switch 50 or 52 is a bidirectional solid state switch, it can be turned ON in any half cycle of the AC voltage.

In one embodiment, a controller 60 is utilized to control the operation of hybrid on-load tap changer 42. Controller 60 triggers the rotary or linear switch to move fingers 44, 46, 48 from one tap to another tap when a tap change signal is received. The tap change signal may be received from another controller or may be generated by controller 60 based on measured electrical parameters and/or certain voltage limits at the transformer input or output, or at other points in the grid. Controller 60 further controls switching of solid state switches 50, 52.

During steady state, fingers 44, 46, 48 are all connected to the same tap or only finger 48 is connected to a tap and fingers 44, 46 are in air (i.e., not connected to any tap) depending on the mechanical design of the tap changer. This may be called as a non-bridging position. It should be noted that when the two side fingers 44, 46 are connected to two different taps, it may be called as bridging position. Furthermore, during normal operation both solid state switches 50, 52 are not conducting either due to being in air (i.e. isolated), or switched off, or both. The current then flows from the transformer tap to power terminal 55 via main finger 48 only. When the tap change signal is received, hybrid on-load tap changer 42 goes from non-bridging position to a bridging position and then back to a non-bridging position. The bridging position only serves as a short transition position. Fingers 44, 46 and 48 sequentially break a contact with the first tap and then make a contact with the second tap during the tap change operation. Furthermore, solid state switches 50, 52 are utilized to commutate the current from the first tap to the second tap during the short transition period when the two fingers are at the bridging position.

FIGS. 3*a* to 3*j* show schematic diagrams of various steps in an operation of hybrid on-load tap changer 42 of FIG. 2 in accordance with an embodiment of the present invention. It should be noted that for ease of illustration only taps A and B instead of all taps of electronic tap changer 42 are shown in FIGS. 3*a* to 3*j*. FIGS. 3*a* to 3*j* specifically show the transition from a non-bridging position at tap A (FIG. 3*a*) to a non-bridging position at tap B (FIG. 3*j*). In step 1 (FIG. 3*a*), a tap change command is set by either a system operator or a controller 60. In this step, just before the tap change command is received, electronic tap changer 42 is in a non-bridging position i.e., fingers 44, 46, 48 are connected to tap A. Solid state switches 50, 52 are switched off and hence are not conducting. This state provides a normal current path for the load 58 (FIG. 2) via main finger 48. Alternatively, side fingers 44, 46 could be in the air at a non-bridging position. In one embodiment, secondary winding 16 (FIG. 2) may be of any transformer such as a single or three phase transformer which is connected to the power grid and the load is then a plurality of energy consumption devices.

In step 2 (FIG. 3*b*), after the tap change command is received, the rotary or linear mechanism starts moving the three fingers from tap A towards tap B, and first solid state switch 52 is switched on. The load current is then shared between the main finger 48 and first solid state switch 52. It should be noted that if side fingers 44, 46 are in the air at the non-bridging position (FIG. 3*a*), first solid state switch 52 is switched on after finger 46 makes contact with tap A. FIG. 3*c* shows a step 3 in which second side finger 44 breaks a contact with tap A. In one embodiment, the mechanism to mechanically move fingers 44, 46, 48 from tap A to tap B may be a rotary mechanism as in FIG. 1. In step 4 (FIG. 3*d*), main finger 48 breaks a contact with tap A and thus stops conducting. The entire current is therewith diverted to a first current path via first solid state switch 52. This facilitates arc free transition of current from main finger 48 to first solid state switch 52. FIG. 3*e* shows a step 5 in which second side finger 44 makes a contact with tap B while first side finger 46 is still in contact with tap A. The two side fingers 44, 46 are now at a bridging position between two adjacent taps A and B.

In step 6 (FIG. 3*f*), the load current is commutated from first side finger 46 to second side finger 44 while the two fingers 44, 46 are still in bridging position between taps A and B. This is achieved through an adequate current commutation method between first solid state switch 52 and second solid state switch 50, which enables diverting current from second side finger 46 to first side finger 44 without causing a short circuit between the two adjacent taps A and B. The current is therewith diverted or commutated from first current path via first solid state switch 52 to a second current path via second solid state switch 50 without arcing. In step 7 (FIG. 3*g*), first side finger 46 breaks the contact with tap A at zero current and therefore without any arcing. Furthermore, in step 8 (FIG. 3*h*), main finger 48 makes a contact with tap B and starts conducting. FIG. 3*i* shows step 9 where first side finger 46 arrives at tap B. First solid state switch 52 is still switched off and the load current is shared between main finger 48 and second side finger 44. In step 10 (FIG. 3*j*), second solid state switch 50 is also switched off, thus, transferring the current back to the normal current path via the main finger 48 and completing a transition from the non-bridging state at tap A to the non-bridging state at tap B. Alternatively, side fingers 44, 46 could be in the air at a non-bridging position. In this case, the second solid state switch 50 is switched off before the second side finger 44 breaks contact with tap B, and the first side finger 46 does not make contact with tap B at the end of the tap change from tap A to tap B.

In one embodiment, the disconnection instance of solid state switch 50 or 52 is based on a zero crossing or a near zero crossing of a current waveform passing through them so as to reduce the voltage stress on the switches. In one embodiment, controller 60 utilizes a mechanism to detect when solid state switches 50 and 52 are in correct modes for commuting the current and sends gate signals accordingly.

FIG. 4 shows a schematic diagram of a solid state switch 70 in accordance with an embodiment of the present invention. Solid state switch 70 is a bidirectional switch formed by a combination of a diode bridge 72 and an unidirectional switch 74. In short, when conducting, the current in unidirectional switch 74 always flows in one direction (e.g., top to bottom) and any one of the left pair of diodes 76, 78 and any one of the right pair of diodes 80, 82 conducts simultaneously to achieve a bidirectional current flow. For example, a current flows from a terminal 84 to a terminal 86 via diode 76, unidirectional switch 74 and diode 82, whereas a current flow from terminal 86 to inductor 84 via diode 80, unidirectional switch 74 and diode 78.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of switching taps of an on-load tap changer, the method comprising:

providing a main finger, a first side finger including a first solid state switch and a second side finger including a second solid state switch, wherein the main finger, the first side finger and the second side finger are utilized to provide a connection between the taps and a power terminal of the on-load tap changer;

triggering the on-load tap changer to shift the fingers from a first tap to a second tap of the on-load tap changer when a tap change signal is received;

utilizing the first solid state switch and the second solid state switch to commutate a current during the tap change operation;

wherein one end of each of the main finger, the first side finger and the second side finger is connected to the power terminal of the on-load tap changer.

2. The method of claim 1 comprising breaking a contact of the second side finger, the main finger and the first side finger with the first tap in a sequence and making a contact of the second side finger, the main finger and the first side finger with the second tap in a sequence.

3. The method of claim 2 comprising making a contact of the first side finger with the first tap before the main finger breaks the contact with the first tap and making a contact of the second side finger with the second tap before the main finger makes the contact with the second tap.

4. The method of claim 3 comprising switching on the first solid state switch to provide an additional current path between the first tap and the power terminal before the main finger breaks the contact with the first tap and stops a normal current path via main finger between the first tap and the power terminal.

5. The method of claim 3 comprising making a contact of the second side finger with the second tap before the first side finger breaks the contact with the first tap.

6. The method of claim 5 comprising switching on the second solid state switch to provide a current path between the second tap and the power terminal via the second solid state switch and switching off the first solid state switch to stop the current path between the first tap and the power terminal via the first solid state switch based on a current commutation method between the first solid state switch and the second solid switch.

7. The method of claim 6, wherein the current commutation from the first solid state switch to the second solid switch is performed after the main finger breaks the contact with the first tap and stops a normal current path between the first tap and the power terminal and before the main finger makes a contact with the second tap and provides a normal current path between the second tap and the power terminal.

8. The method of claim 7 comprising switching off the second solid state switch to stop the current path between the second tap and the power terminal via the second solid state after the main finger makes a contact with the second tap and a establishes a normal current path via main finger between the second tap and the power terminal.

9. The method of claim 1, wherein the first and the second solid state switches comprise bidirectional switches or unidirectional switches.

10. The method of claim 9, wherein the bidirectional switch comprises a thyristor pair connected in antiparallel configuration or a triode for alternating current (TRIAC) or a combination of unidirectional switches.

11. The method of claim 9, wherein the bidirectional switch comprises a combination of a unidirectional switch and a diode bridge.

12. An on-load load tap changer comprising:

a main finger, a first side finger including a first solid state switch, and a second side finger including a second solid state switch, wherein the main finger, the first side finger and the second side finger are utilized to provide a connection between the taps and a power terminal of the on-load tap changer;

a controller configured to provide switching signals to the first solid state switch and the second solid state switch to commutate a current between the first solid state switch and the second solid switch during the tap change operation; and wherein one end of each of the main finger, the first side finger and the second side finger is connected to the power terminal of the on-load tap changer.

13. The load tap changer of claim 12, wherein the first and the second solid state switches comprise bidirectional switches or unidirectional switches.

14. The load tap changer of claim 12, wherein the controller is further configured to control the tap change operation steps, the steps comprising:

a) switching on the first solid state switch to provide an additional current path between the first tap and the power terminal before the main finger breaks the contact with the first tap and stops a normal current path via main finger between the first tap and the power terminal;

b) switching on the second solid state switch to provide a current path between the second tap and the power terminal via the second solid state switch and switching off the first solid state switch to stop the current path between the first tap and the power terminal via the first solid state switch based on a current commutation method between the first solid state switch and the second solid switch after the second side finger makes a contact with the second tap; and c) switching off the second solid state switch to stop the current path between the second tap and the power terminal via the second solid state after the main finger makes a contact with the second tap and a establishes a normal current path via main finger between the second tap and the power terminal.

15. The load tap changer of claim 12 further comprising a rotary mechanism or a linear mechanism to mechanically move the main finger, the first side finger and the second side finger from the first tap to the second tap.

16. The load tap changer of claim 12, wherein the controller is further configured to provide a clockwise or anti-clockwise tap change signal.

17. A method of operating an on-load tap changer comprising:

providing a main finger, a first side finger including a first solid state switch and a second side finger including a second solid state switch, wherein the main finger, the first side finger and the second side finger are utilized to provide a connection between the taps and a power terminal of the on-load tap changer;

triggering the on-load tap changer to shift the fingers from a first tap to a second tap of the on-load tap changer when a tap change signal is received, wherein the first side finger breaks a contact with the first tap and then makes a contact with the second tap after the main finger and the second side finger breaks a contact with the first tap and then make a contact with the second tap before the main finger;

transferring an electric current flowing in the main finger to the first solid state switch;

diverting the electric current flowing in the first solid state switch to the second solid state switch;

transferring the electric current flowing in the second solid state switch back to the main finger during the tap change operation;

wherein one end of each of the main finger, the first side finger and the second side finger is connected to the power terminal of the on-load tap changer.

18. The method of claim 17, wherein the first and the solid state switches comprise bidirectional switches or unidirectional switches.

19. The method of claim 18, wherein the bidirectional switch comprises a thyristor pair connected in antiparallel configuration or a triode for alternating current (TRIAC) or a combination of unidirectional switches.

20. The method of claim 18, wherein the bidirectional switch comprises a combination of a unidirectional switch and a diode bridge.

* * * * *